US009068422B2

(12) United States Patent
Hart et al.

(10) Patent No.: US 9,068,422 B2
(45) Date of Patent: Jun. 30, 2015

(54) SEALING MECHANISM FOR SUBSEA CAPPING SYSTEM

(76) Inventors: Brian Hart, Wakefield (GB); Cameron J. Berry, Leeds (GB)

( * ) Notice: Subject to any disclaimer, the term of this patent is extended or adjusted under 35 U.S.C. 154(b) by 684 days.

(21) Appl. No.: 13/344,843

(22) Filed: Jan. 6, 2012

(65) Prior Publication Data

US 2013/0175054 A1 Jul. 11, 2013

(51) Int. Cl.
*E21B 33/035* (2006.01)
*E21B 33/037* (2006.01)
*E21B 33/038* (2006.01)

(52) U.S. Cl.
CPC ..... *E21B 33/037* (2013.01); *E21B 33/035* (2013.01); *E21B 33/038* (2013.01)

(58) Field of Classification Search
CPC ..... E21B 33/03; E21B 33/037; E21B 33/038; E21B 33/12; E21B 33/035
USPC ..... 166/363, 338, 344, 351, 360, 368, 387, 166/97.1, 85.3; 277/323, 328
See application file for complete search history.

(56) References Cited

U.S. PATENT DOCUMENTS 3,325,190 A * 6/1967 Eckert et al. ..... 285/18
3,495,443 A * 2/1970 Switzer et al. ..... 73/40.5 R
4,057,108 A * 11/1977 Broussard ..... 166/371
5,433,274 A * 7/1995 Graff et al. ..... 166/368
5,535,827 A * 7/1996 Graff et al. ..... 166/368
5,785,121 A * 7/1998 Dallas ..... 166/90.1
5,819,851 A * 10/1998 Dallas ..... 166/308.1
5,860,478 A 1/1999 Coutts et al.
6,554,324 B1 4/2003 Herman
8,322,441 B2 * 12/2012 Fenton ..... 166/368
8,443,898 B1 * 5/2013 McClinton et al. ..... 166/363
8,746,347 B2 * 6/2014 Willoughby ..... 166/344
2002/0121380 A1 9/2002 Doane et al.
2004/0251031 A1 12/2004 Reimert
2005/0205262 A1 * 9/2005 Reimert et al. ..... 166/348
2008/0277120 A1 * 11/2008 Hickie ..... 166/308.1
2010/0300705 A1 12/2010 Nelson
2012/0006557 A1 * 1/2012 Fraser et al. ..... 166/350

OTHER PUBLICATIONS

Hart et al., U.S. Appl. No. 13/541,716, filed Jul. 4, 2012.
Copenheaver, PCT International Search Report and Written Opinion for PCT/US2012/072211, Mar. 1, 2013.

* cited by examiner

*Primary Examiner* — Matthew Buck
(74) *Attorney, Agent, or Firm* — Eubanks PLLC

(57) ABSTRACT

A sealing mechanism is provided. In one embodiment, a system includes a connector configured to couple one or more flow-control valves to equipment installed at a well and an isolation sleeve configured to be retained by the connector. The isolation sleeve may include a seal and a hydraulically actuated piston disposed adjacent one another about a body of the isolation sleeve such that actuation of the piston engages the seal. Additional systems, devices, and methods are also disclosed.

19 Claims, 5 Drawing Sheets

SEALING MECHANISM FOR SUBSEA CAPPING SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

More particularly, wellhead assemblies typically include pressure-control equipment, such as a blowout preventer, to control flow of fluid (e.g., oil or natural gas) from a well. As will be appreciated, uncontrolled releases of oil or gas from a well via the wellhead assembly (also referred to as a blowout) are undesirable. If the control of flow from the well is lost for any reason, it is important to quickly regain such control. But regaining control of a well may be complicated by various factors, including high pressures of fluid escaping the well, potential damage caused to components installed at the well, and the depth of a wellhead in a subsea context, to name but a few. Consequently, there is a need for techniques to efficiently and effectively regain control of a well in a blowout condition.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to a sealing mechanism for coupling two components to one another. The sealing mechanism includes an isolation sleeve with a hydraulically actuated piston to energize a sealing element and effect a seal between the isolation sleeve and another component. In some embodiments, the isolation sleeve is retained in a connector of a capping system and facilitates sealing of the connector and the capping system to part of a wellhead assembly, such as to the wellhead or to a blowout preventer stack. For example, the isolation sleeve may be landed into a wellhead housing and the piston may then be actuated to seal the capping system to the wellhead housing. And in at least one embodiment, the isolation sleeve may enable the capping system to seal against equipment of the wellhead assembly (e.g., the wellhead housing or the blowout preventer stack) during a blowout condition, particularly if a primary gasket sealing area of the equipment for creating a seal with other components (e.g., the connector of the capping system) has been damaged.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
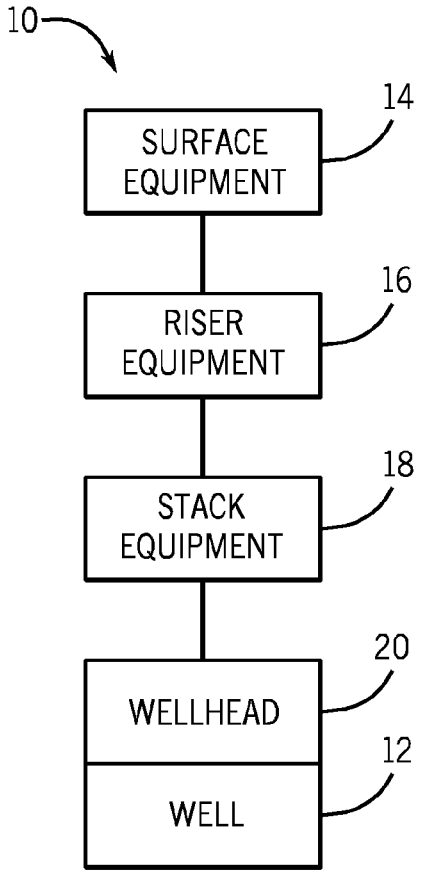
FIG. 1 is a block diagram of a resource extraction system in accordance with one embodiment of the present disclosure.

Turning now to the present figures, a resource extraction system 10 is illustrated in FIG. 1 in accordance with one embodiment. Notably, the system 10 facilitates extraction of a resource, such as oil or natural gas, from a well 12. As depicted, the system 10 is a subsea system that includes surface equipment 14, riser equipment 16, and stack equipment 18, for extracting the resource from the well 12 via a wellhead 20. In one subsea resource extraction application, the surface equipment 14 is mounted to a drilling rig above the surface of the water, the stack equipment 18 is coupled to the wellhead 20 near the sea floor, and the various equipment 14 and 18 is coupled to one another via the riser equipment 16.

As will be appreciated, the surface equipment 14 may include a variety of devices and systems, such as pumps, power supplies, cable and hose reels, control units, a diverter, a gimbal, a spider, and the like. Similarly, the riser equipment 16 may also include a variety of components, such as riser joints, fill valves, control units, and a pressure-temperature transducer, to name but a few. The riser equipment 16 facilitates transmission of the extracted resource to the surface equipment 14 from the stack equipment 18 and the well 12. The stack equipment 18, in turn, may include a number of components, such as blowout preventers, production trees (also known as "Christmas" trees), and the like for extracting the desired resource from the wellhead 20 and transmitting it to the surface equipment 14 via the riser equipment 16.

Figure 2:
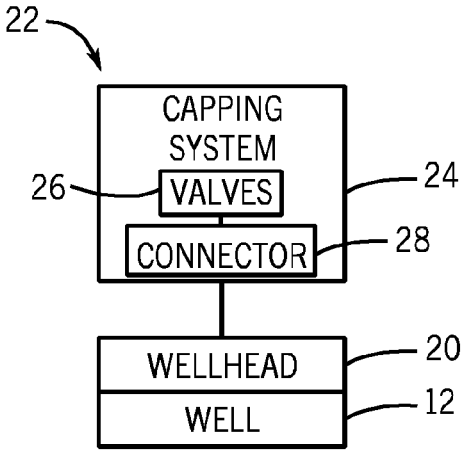
FIG. 2 generally depicts the coupling of a well capping system to a wellhead in accordance with one embodiment of the present disclosure.
Figure 3:
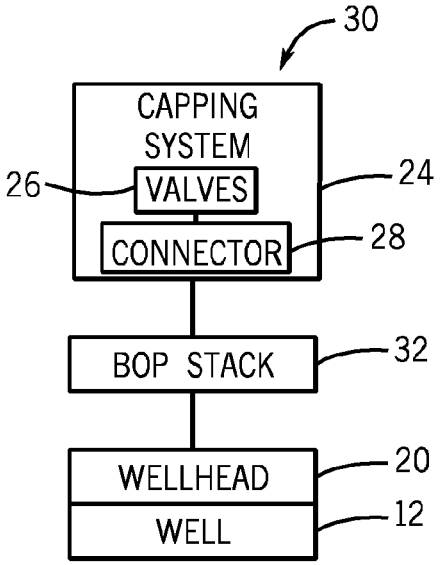
FIG. 3 generally depicts the coupling of the well capping system to a blowout preventer stack installed on a wellhead in accordance with one embodiment of the present disclosure.

If a blowout occurs at a well, a capping system may be used in some instances to seal the well and reestablish control. Examples of the use of such capping systems are provided in FIGS. 2 and 3. In one embodiment generally represented by block diagram 22 in FIG. 2, a capping system 24 is attached to the wellhead 20 (e.g., following removal of the stack equipment 18 from the wellhead 20). The capping system 24 includes one or more valves 26, such as a blowout preventer, for controlling flow from the wellhead 20. The capping system 24 also includes an adapter or connector 28 that facilitates connection of the capping system 24 onto the wellhead 20.

But the connector 28 may also facilitate connection of the capping system 24 onto other equipment installed at a well. For instance, in another embodiment generally represented by block diagram 30 in FIG. 3, the capping system 24 is attached to a blowout preventer stack 32 via the connector 28. When not in use, the capping system 24 may be kept on "stand-by" as safety equipment for responding to a blowout. And though the capping system 24 may be used with subsea well installations, it is noted that the capping system 24 may also be used with other well installations (e.g., equipment of surface wells).

Figure 4:
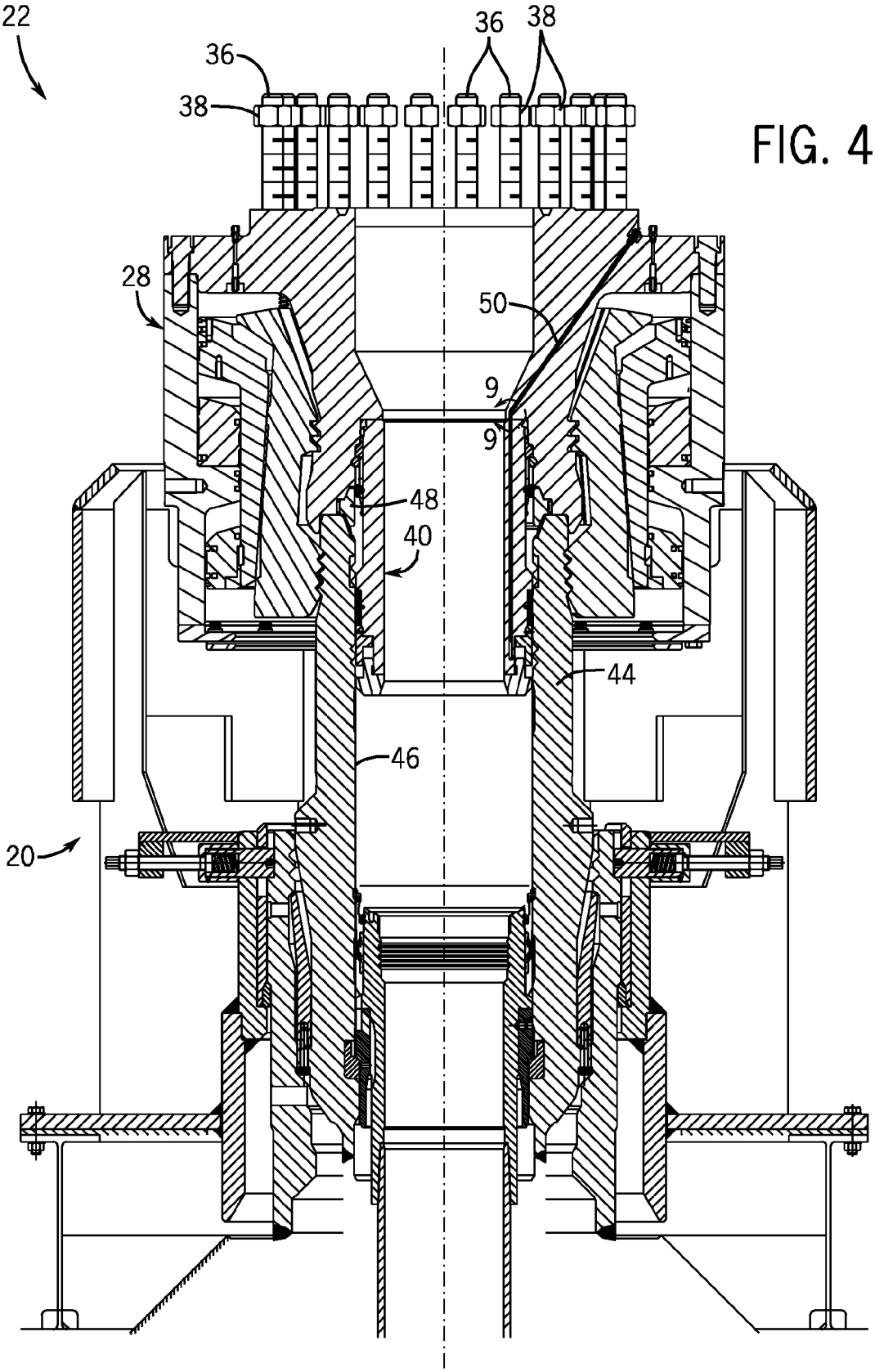
FIG. 4 is a cross-section of a connector of a well capping system with an isolation sleeve connected to a wellhead component in accordance with one embodiment of the present disclosure.

Additional features relating to the connector 28 and its connection to other equipment installed at the well 12, in accordance with one embodiment, are depicted in FIG. 4. The connector 28 is illustrated in this figure as connected to the wellhead 20 (as in FIG. 2). But it will be appreciated that the connector 28 may be connected to other equipment as well, including the blowout preventer stack 32 of FIG. 3.

The connector 28 includes studs 36 and nuts 38 at one end for coupling the connector 28 to other components (e.g., components of the capping system 24). An isolation sleeve 40 is retained in an opposite end of the connector 28. The connector 28 and the isolation sleeve 40 may be aligned with a desired component of equipment installed at the well 12. Then, the connector 28 may be moved to insert the isolation sleeve 40 into a bore of the desired component and the connector 28 may be secured to the component. For example, in the presently depicted embodiment, the connector 28 is clamped onto a housing component 44 of the wellhead 20 having a bore 46 that receives the isolation sleeve 40.

But it is again noted that the isolation sleeve 40 may be used with other components (e.g., the isolation sleeve 40 may be inserted into a bore of a component of the blowout preventer stack 32). And various dimensions of the isolation sleeve 40 may be varied depending on the desired application. For instance, the lengths of isolation sleeves 40 may differ between embodiments to correspond to areas to be sealed by the isolation sleeves 40, or the diameters of the isolation sleeves 40 may differ according to the bore sizes of the components in which the isolation sleeves 40 are to be installed. By way of further example, the connector 28 may be an 18¾ inch H4-style connector, the housing component 44 may be an 18¾ inch H4 profile wellhead housing, and the isolation sleeve 40 may be an 18¾ inch isolation sleeve.

A gasket 48 is provided at the interface between the end of the housing component 44 and the connector 28. In one embodiment, the gasket 48 is a high-performance metal-to-metal sealing ring, such as an AX Gasket available from Cameron International Corporation of Houston, Tex. In some instances, the gasket 48 may be sufficient to seal the interface between the housing component 44 and the connector 28.

But in other instances, such as during a blowout, the end of the housing component 44 may be damaged in a manner that prevents the gasket 48 from adequately sealing the connection between the component 44 and the connector 28. In such cases, the isolation sleeve 40 provides additional sealing to inhibit fluid leakage from between the housing component 44 and the connector 28. As described in greater detail below, the isolation sleeve 40 is a hydraulically actuated isolation sleeve, and the connector 28 includes a passageway 50 for routing control fluid to and from the sleeve. While the isolation sleeve 40 is described below in the context of a connector and capping system, the isolation sleeve 40 may also be used in other contexts. For example, the hydraulically actuated isolation sleeve 40 may be used as an alternative to a more conventional isolation sleeve used in a horizontal, dual-bore subsea Christmas tree or between other wellhead assembly components.

Figure 6:
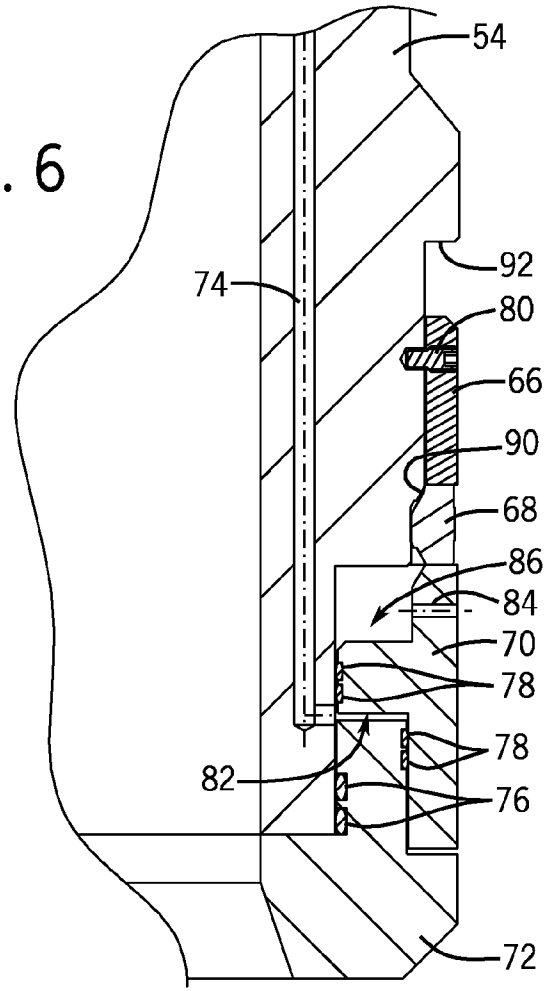
FIG. 6 depicts a piston and seal arrangement of the isolation sleeve in FIG. 5.
Figure 5:
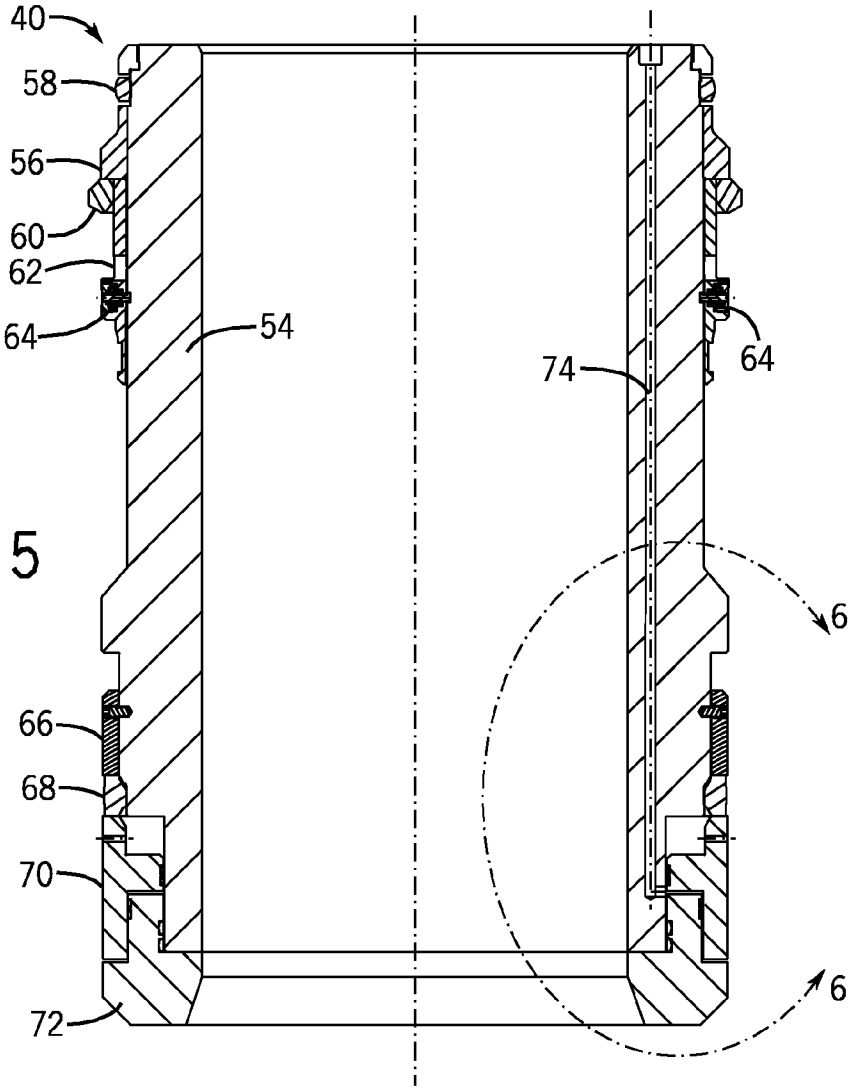
FIG. 5 is a cross-section depicting certain features of the isolation sleeve of FIG. 4, including a seal in a relaxed state, in accordance with one embodiment of the present disclosure.
Figure 8:
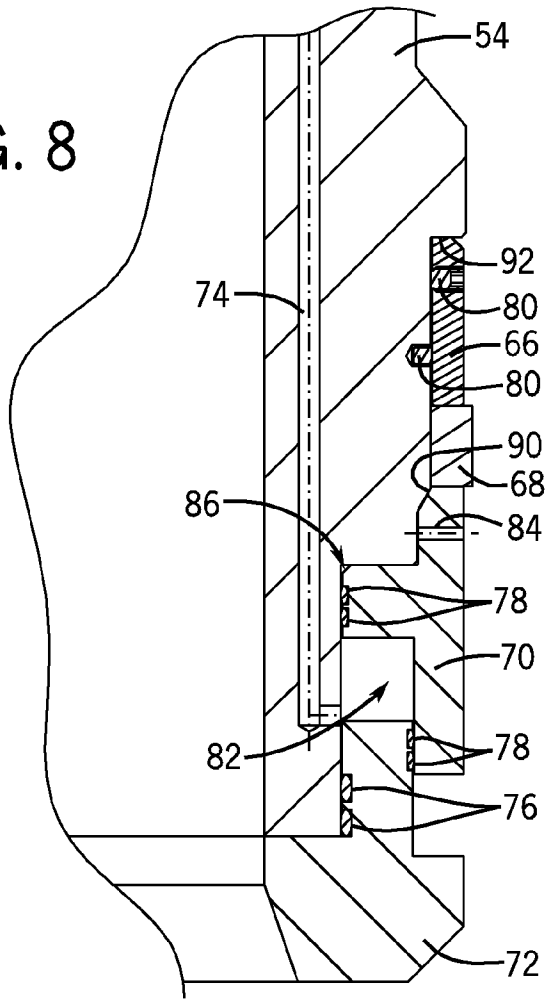
FIG. 8 depicts the piston and seal arrangement after actuation of the piston as in FIG. 7.
Figure 7:
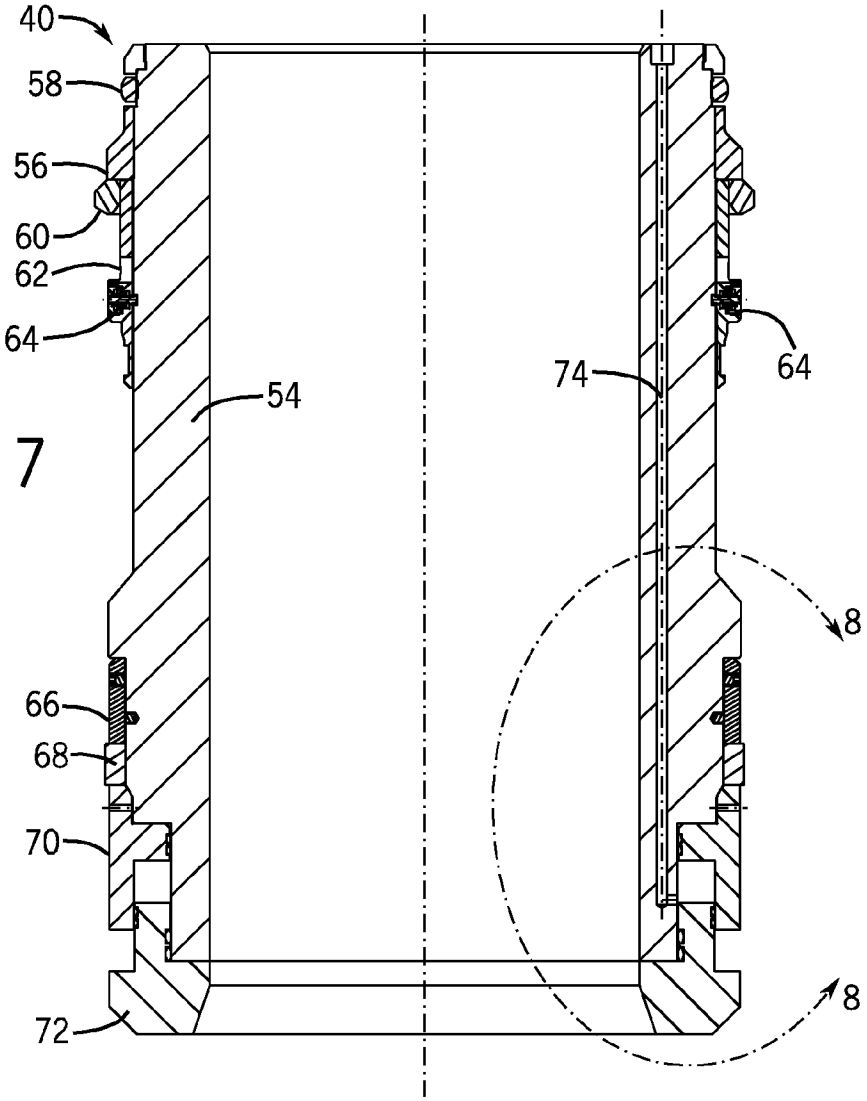
FIG. 7 is a cross-section of the isolation sleeve in FIG. 5 after actuation of the piston to engage and energize the seal in accordance with one embodiment.

Detailed views of the example isolation sleeve 40 of FIG. 4 are provided in FIGS. 5-8. Particularly, FIGS. 5 and 6 depict the isolation sleeve 40 having a seal 68 in a relaxed state, while FIGS. 7 and 8 depict the isolation sleeve 40 with the seal 68 in an energized state. The isolation sleeve 40 includes a generally cylindrical main body 54 defining a bore to allow flow of fluid (e.g., production fluid) through the isolation sleeve 40.

As depicted in FIGS. 5 and 7, the upper end of the isolation sleeve 40 includes a shoulder 56 and a seal 58. The shoulder 56 may be threaded onto the main body 54 to retain a split ring 60 and an actuator ring 62, which are used to secure the isolation sleeve 40 in another component, such as the connector 28. Particularly, the actuator ring 62 is wedged between the split ring 60 and the main body 54, causing the outer diameter of the split ring 60 to expand beyond the outer diameter of the shoulder 56 and engage a bore of another component (e.g., the bore of connector 28 in FIG. 4). Shear pins 64 may be used to ensure the actuator ring 62 is locked in position to prevent the actuator ring 62 from inadvertently moving out of engagement with the spilt ring 60. The isolation sleeve 40 may be disengaged from the connector 28 (or another component) by shearing or removing the shear pins 64 and disengaging the actuator ring 62 from between the split ring 60 and the main body 54 to allow the split ring 60 to contract and disengage the adjacent component.

The other end of the isolation sleeve 40 includes a sealing mechanism for creating a seal between the isolation sleeve 40 and another component, such as equipment of the wellhead 20 or the blowout preventer stack 32. In the presently depicted embodiment, the sealing mechanism includes a collar 66, a seal 68, and a piston 70. An end cap 72 may be threaded onto an end of the isolation sleeve 40 to retain these components about the main body 54. As discussed in greater detail below, the piston 70 is a hydraulically actuated piston that is controlled by hydraulic pressure fed to the piston 70 via a passageway 74 through the main body 54.

Certain additional features of the isolation sleeve 40 may be better understood with reference to FIGS. 6 and 8, which depict the collar 66, the seal 68, and the piston 70 of FIGS. 5 and 7 in greater detail. The isolation sleeve 40 includes seals 76 and 78 between the main body 54, the piston 70, and the end cap 72. The piston 70 is disposed in a recess of the main body 54 and divides the recess into a first region or chamber 82 and a second region or chamber 86. The seals 76 and 78 isolate the first region 82 from the second region 86 and the environment about the isolation sleeve 40.

Further, the first region 82 is connected to the passageway 74 to allow hydraulic fluid to be routed into or from the region 82 to actuate the piston 70. As depicted in FIG. 6, the seal 68 is in a relaxed position in which its outer diameter is sufficiently small such that the isolation sleeve 40 may be inserted into the bore of another component (e.g., of the wellhead 20 or the blowout preventer stack 32). The seal 68 is retained in this relaxed state by the collar 66, which is secured to the main body 54 with one or more shear pins 80.

Once the isolation sleeve 40 is aligned with and positioned in the bore of a desired component, hydraulic pressure with the region 82 may be increased to actuate the piston 70. More particularly, hydraulic fluid may be routed (e.g., pumped) into the region 82 on one side of the piston 70 (e.g., via the passageways 50 and 74) to create a positive pressure differential between the regions 82 and 86, resulting in an upward force on the piston 70 in FIG. 6. Upon the application of sufficient force to the piston 70 from the pressure differential, the one or more shear pins 80 break and the piston 70 begins to drive the seal 68 and the collar 66 along the main body 54 toward the position illustrated in FIG. 8.

As the piston 70 is driven along the main body 54 by the hydraulic force, the volume of the region 82 increases while that of the region 86 decreases. To facilitate actuation, the piston 70 includes vent holes 84 to allow fluid in the compressed region 86 to escape. The piston 70 drives the seal 68 over a sloped shoulder 90, toward abutment 92, onto a portion of the main body 54 having a wider diameter, causing the outer diameter of the seal 68 to increase. In the presently depicted embodiment, the seal 68 is an elastomeric seal and driving the seal 68 over the sloped shoulder 90 energizes the seal 68 against the component in which the isolation sleeve 40 is inserted (e.g., against the bore 46 of the wellhead 20 in FIG. 4.)

When the capping system 24 is installed on the wellhead 20 (or on other desired equipment at the well 12), the one or more valves 26 may be activated to inhibit flow of fluid through the well capping system. Once the well has been brought under control and the flow of well bore fluids halted, the capping system 24 may no longer be required. The isolation sleeve 40 may be de-energized and removed from the bore 46 by venting the hydraulic pressure from region 82 to release the piston 70, unlocking connector 28, and then pulling the isolation sleeve 40 from the bore 46 (e.g., by pulling the capping system 24 from the wellhead 20). It is noted that the relaxation of the piston 70 allows the seal 68 to slide back down the sloped shoulder 90, allowing the isolation sleeve 40 to be more easily retrieved from the bore 46.

Figure 9:
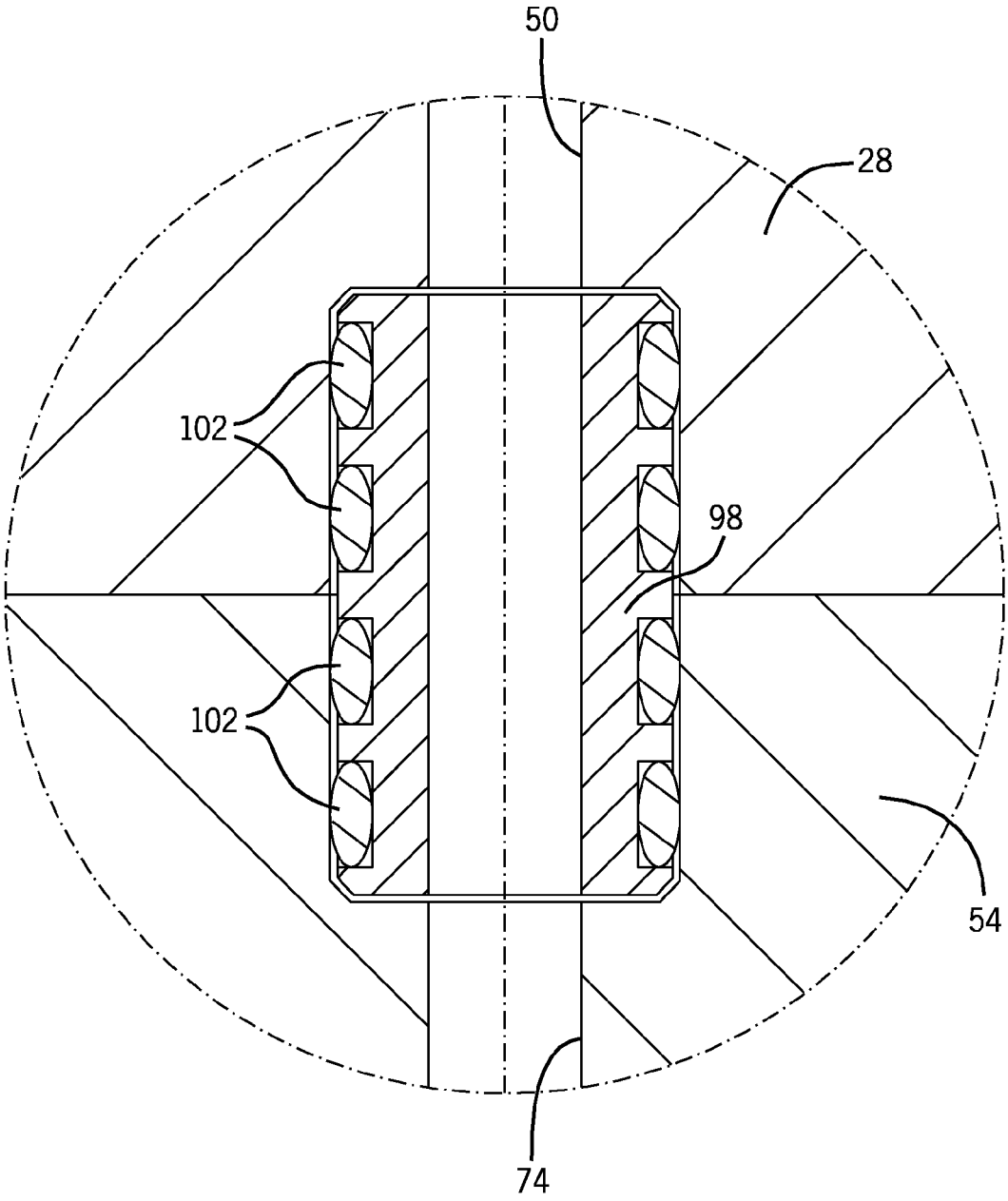
FIG. 9 is a partial cross-section depicting a sealing arrangement at the connection of passageways through the connector and the isolation sleeve body in accordance with an embodiment of the present disclosure.

In accordance with one embodiment, a seal sub arrangement for coupling the passageway 50 of the connector 28 to the passageway 74 of the isolation sleeve 40 is depicted in FIG. 9. This arrangement includes a hollow pin member 98 with ends received in the main body 54 of the isolation sleeve 40 and the component of the connector 28 receiving the isolation sleeve 40. The bore of the member 98 connects passageways 50 and 74, allowing hydraulic fluid to be routed to and from the region 82 behind the piston 70. Seals 102 are provided to prevent leaking from the passageways 50 and 74 at the interface of the main body 54 of the isolation sleeve 40 and the component of the connector 28 in which the sleeve 40 is installed.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a connector configured to couple one or more flow-control valves to equipment installed at a well; and an isolation sleeve configured to be retained by the connector, the isolation sleeve including a body, a seal disposed about the body, and a hydraulically actuated piston disposed about the body adjacent to the seal, wherein the hydraulically actuated piston is positioned to engage the seal and to drive the seal along the body in response to actuation.

2. The system of claim 1, wherein the seal includes an elastomeric seal.

3. The system of claim 2, wherein the body includes a shoulder and the hydraulically actuated piston is positioned to drive the seal over the shoulder onto a portion of the body with a larger circumference in response to actuation.

4. The system of claim 3, wherein the body, the seal, and the hydraulically actuated piston are configured to enable the hydraulically actuated piston to energize the seal in response to actuation such that the seal engages a bore of a component of the equipment installed at the well when the isolation sleeve is positioned within the bore.

5. The system of claim 1, wherein the connector and the body of the isolation sleeve include passageways connected to one another to route hydraulic control fluid through the connector and the body of the isolation sleeve to the hydraulically actuated piston.

6. The system of claim 1, comprising the one or more flow-control valves.

7. The system of claim 1, wherein the connector is configured to couple the one or more flow-control valves to a blowout preventer installed at the well.

8. The system of claim 1, wherein the connector is configured to couple the one or more flow-control valves to a wellhead component installed at the well.

9. The system of claim 1, comprising the equipment installed at the well.

10. A system comprising:

an isolation sleeve including a body, a seal disposed about the body, and a piston disposed about the body that divides a recess in the body into first and second regions, the body including an internal passageway connected to the first region to enable fluid to be routed into the first region via the internal passageway to actuate the piston and energize the seal by driving the seal along the body.

11. The system of claim 10, comprising a collar disposed about the body such that the seal is disposed between the collar and the piston.

12. The system of claim 11, wherein the collar is secured to the body with one or more shear pins.

13. The system of claim 10, wherein the piston includes at least one vent hole connected to the second region to allow fluid in the second region to exit the recess through the at least one vent hole.

14. The system of claim 10, comprising a connector having a first end configured to retain and seal the isolation sleeve within a component of a well capping system and a second end configured to enable sealing with a wellhead assembly component.

15. A method comprising:

aligning a connector of a well capping system with equipment installed at a well, the connector including an isolation sleeve;

moving the isolation sleeve into a bore of the equipment installed at the well; and applying hydraulic pressure to a side of a piston of the isolation sleeve to actuate the piston and engage a seal to cause the seal to be driven over a shoulder of the isolation sleeve to energize the seal against the bore of the equipment installed at the well.

16. The method of claim 15, comprising activating a valve of the well capping system to inhibit flow of fluid through the well capping system.

17. The method of claim 15, comprising:

venting the hydraulic pressure to release the piston; and removing the isolation sleeve from the bore of the equipment.

18. The method of claim 15, wherein moving the isolation sleeve into a bore of the equipment installed at the well includes moving the isolation sleeve into a bore of a wellhead component or a blowout preventer.

19. The method of claim 15, wherein applying hydraulic pressure to the side of the piston includes routing hydraulic control fluid through both the isolation sleeve and another component of the connector into a chamber adjacent the side of the piston.

* * * * *